United States Patent [19]

Stöwer

[11] 4,435,167

[45] Mar. 6, 1984

[54] CENTRIFUGE

[75] Inventor: Reinhard Stöwer, Au in der Hallertau, Fed. Rep. of Germany

[73] Assignee: Compur-Electronic GmbH, Munich, Fed. Rep. of Germany

[21] Appl. No.: 304,409

[22] Filed: Sep. 21, 1981

[30] Foreign Application Priority Data

Sep. 27, 1980 [DE] Fed. Rep. of Germany ..... 3036538

[51] Int. Cl.[3] ..... B04B 5/02

[52] U.S. Cl. ..... 494/16

[58] Field of Search ..... 233/26, 27, 1 R; 211/77, 78; 494/16, 20

[56] References Cited

U.S. PATENT DOCUMENTS

| | | | |
|---|---|---|---|
| 1,839,944 | 1/1932 | Barthels | 233/26 |
| 1,997,919 | 4/1935 | Strezynski | 233/26 |
| 3,361,343 | 1/1968 | Lerner | 233/26 |
| 3,377,021 | 4/1968 | Fox et al. | 233/26 |
| 3,938,735 | 2/1976 | Wright et al. | 233/26 |

*Primary Examiner*—Robert W. Jenkins

*Attorney, Agent, or Firm*—Townsend and Townsend

[57] ABSTRACT

A centrifuge with swinging sample vessels has a rotor with curved rolling support faces on which the sample vessels may be rolled as they are moved into and out of a horizontal position by centrifugal force on centrifuging. Because of the use of a system with rolling structures for swinging of the vessels, a design of centrifuge is produced which is simple in structure, needs little upkeep and whose rotor is low in weight and does not have any cup supports or the like for supporting the sample vessels.

15 Claims, 3 Drawing Figures

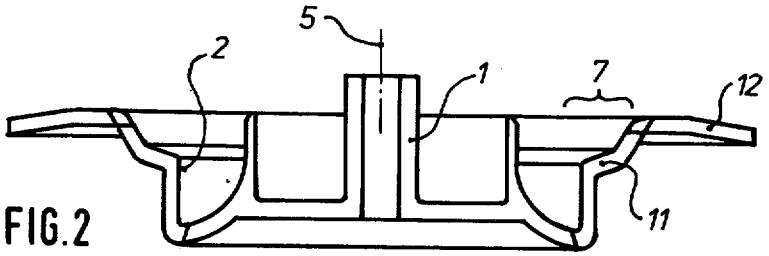
FIG.2
FIG.1
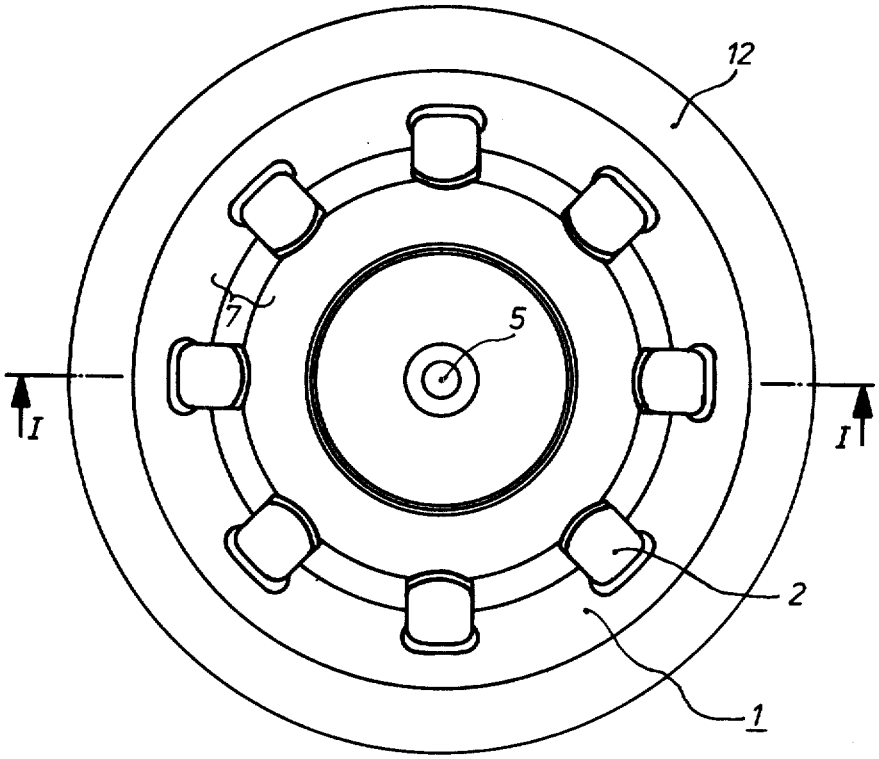

CENTRIFUGE

BACKGROUND OF THE INVENTION

The present invention is with respect to a centrifuge, more specially for centrifuging blood, with at least one vessel for a sample of the substance to be centrifuged and which, when the rotor is put into operation, is turned into a horizontal position by centrifugal force.

In the case of prior art centrifuges, used for medicinal laboratories, the rotor has been so designed that the sample vessels for the substance such as blood to be centrifuged are fixed at an angle of about 45° to the axis of turning of the rotor. In such a position of the vessel full of the substance to be centrifuged, the centrifugal effect is not made best use of, because it is only the vector component lined up with the direction of the sample vessel, that is to say only a part of the full centrifugal force, which is used for the centrifuging operation. For producing a high enough centrifuging effect, the centrifuge has to be run at a high speed. Furthermore, the top face of the substance to be centrifuged, as for example the top face of the blood in the sample vessel, will be at different angles to the axis of turning of the rotor in a way dependent on the speed of turning and, more specially, on turning off the centrifuge in the top, liquid part of the blood, that is to say in the serum or plasma, there will be some flow with the outcome that the serum will be mixed with the blood clot or cake at the serumclot interface. For this reason, the prior art centrifuges do not produce the best possible effect which is desired.

Furthermore, centrifuges have been designed in the prior art in which cups or the like are swingingly joined to the rotor for taking up the vessels filled with the substance to be centrifuged. When the rotor is put into operation, the cups are turned out of a position parallel to the axis of turning into one normal thereto. Although with such a rotor a better centrifuging effect may be produced, the rotor is made very much more complex in design. In fact, such a rotor has to be made up of a large number of separate parts such as turnpins, plain or ball bearings and the like for supporting the swinging cups for the sample vessels so that, in addition to high production costs, much upkeep work is necessary and the centrifuge is likely to get out of order. Furthermore, on centrifuging, it is necessary for not only the vessels with the sample to be centrifuged, but the swinging cups or the like to be accelerated up to the working speed, that is to say there is a large moment of inertia. For this reason, such a prior art centrifuge has to be made very strong in design and generally complex in order to take up the centrifugal forces produced by the relatively high masses.

SHORT OUTLINE OF THE INVENTION

For this reason, one purpose of the present invention is that of designing a centrifuge and, more specially, a sedimentation centrifuge for medicinal laboratories, which makes possible a high level of centrifuging effect using a light-weight rotor and a simple mechanical design.

A further purpose of the invention is that of designing a centrifuge which is simple with respect to upkeep.

A still further purpose of the invention is that of designing a centrifuge which makes do without any further cups or the like for taking up the sample vessel.

For effecting this purpose and still further purposes, a centrifuge of the present invention is characterized in that the rotor and/or the vessel have at least one rolling profile in a plane normal to the plane of rotation and on which the vessel is rolled on its swinging movement into a horizontal position and out of its horizontal position.

Putting it somewhat differently, it will be seen that in the invention the rotor and/or the sample vessel have a rolling profile on which the vessel is rolled when the rotor is started up and because of the centrifugal force is produced the vessel is turned in a plane normal to the plane of rotation. In the centrifuge of the invention, because of the swinging motion, the best possible centrifuging effect is produced without the centrifuge having to be made any more complex in its mechanical design, which would make for a higher price, make it heavier in weight and would make it more likely for the centrifuge to get out of order. In fact, in the invention, the rotor may be made very light because no further cups or the like are needed for the sample vessels and, in fact, the rotor only has cutouts into which the sample vessels may be slipped. For this reason, the rotor is very simple and is free of moving parts. Furthermore, the vessels may be readily put into the rotor without any trouble and may be readily taken therefrom without the liquid therein having to be placed in some other vessel.

The rolling profile or profiles may, as part of a preferred working example of the invention, be in the form of profiled faces or in the form of profiled edges, a useful effect being produced if the vessel has a profile face while the rotor has a profile edge.

The rolling profile of the rotor has to be designed to be in line with the design of the rolling vessel so that rolling of the vessel and, for this reason, swinging thereof, may take place readily in relation to the plane of rotation.

As part of a preferred working example of the invention, only the rotor has a rolling profile and the vessel has a lip rolling on the profile of the rotor when swinging motion takes place. Because normally a certain number of sample vessels will be present for use in a centrifuge, it is cheaper to make the centrifuge with the rolling profile on the rotor while the lip or flange of the sample vessels has a flat face for rolling on the rolling profile of the rotor when the swinging motion takes place. For this reason, the vessels may be very simply produced.

A useful effect is produced if the lip is produced on the sample vessel in one piece therewith. It would, however, furthermore be possible for a lipped ring to be fixed to the sample vessel for centrifuging so that normal laboratory glassware as for example test tubes might be used for centrifuging substances with the present centrifuge. Not only round, but furthermore square vessels or other vessels with corners, might be used in connection with the centrifuge of the invention.

As part of a preferred working example of the invention, the rotor has a number of cutouts for taking up the vessels, such cutouts having the rolling profiles on the sides which are normal to the direction of totation.

For producing the rotor, a useful effect is more specially to be had if in a ring-like part of the rotor, the same has a radially symmetrical form answering to the rolling profile and a number of cutouts are present in this ring part.

LIST OF FIGURES

A detailed account will now be given of the invention using the working examples.

FIG. 1 is a view looking down on a rotor of a centrifuge of the invention without the sample vessels.

FIG. 2 is a cross-section of the rotor of FIG. 1.

DETAILED ACCOUNT OF WORKING EXAMPLE OF THE INVENTION

Figure 3:
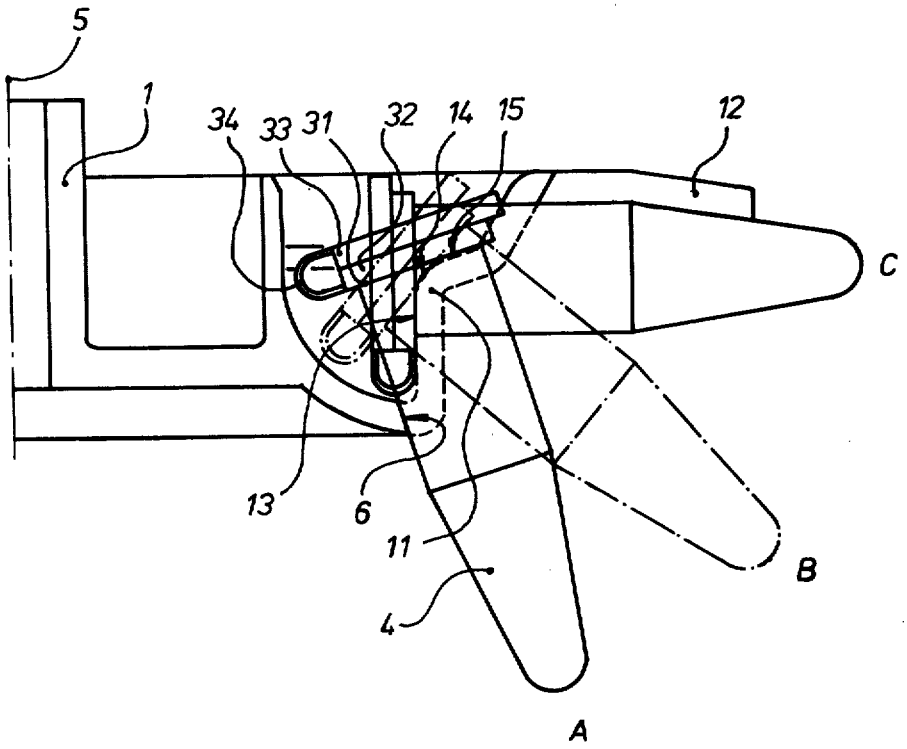
FIG. 3 is a cross-section of part of the centrifuge rotor with the sample vessel in a number of different positions of swinging.

As will be clear from FIGS. 1 and 2, a rotor 1, supported for turning about an axis 5, has cutouts 2, in which centrifuging or sample vessels 4 may be slipped. In a ring-part or a zone 7 (FIG. 1), in which the cutouts 2 as well are positioned, the rotor has a radially symmetrical form in line with the rolling profile. The cutouts 2 are in diametrically opposite pairs to make certain of radially symmetrical loading on the bearings of the rotor.

FIG. 2 is a section on the section line I—I of FIG. 1.

FIG. 3 is a view on a greater scale of the part, to the right of the axis 5 of rotation in FIG. 1, of the rotor 1 with the sample of centrifuging vessel 4 placed in it and in three different positions A, B and C of swinging. When the rotor is not being turned, the sample vessel 4 will be in position A, in which case an outer face part of the sample vessel 4 is resting on a support face 6 of rotor 1. It is to be noted that the sample vessel 4 may be furthermore kept in an upright position when the rotor is not turning. The resting position with an angle to the axis of rotation as in FIG. 3 is in fact only a special case in the present working example which is in connection with special needs in this case.

On the top end of sample vessel 4, there is a lip 32 running out from the outer vessel wall and having a rolling face 31. When the rotor is in operation, the sample vessel 4 is turned swingingly, because of the centrifugal force, out of the position A through the position B into the position C in which the sample vessel 4 is normal to the axis 5 of rotation and in which it is rested against a stop 12 of rotor 1. A vessel cover 33 may be joined with lip 32 by way of a film hinge 34.

The rolling curve or profile 11 of the rotor 1 has a rolling part 13, which is upright or is at a small angle to the axis 5 of rotation and which is joined up by way of a swinging part 14 with a rolling part 15 which, in the present working example, is at an acute angle to a line normal to the axis 5 of rotation of the rotor. It is to be noted once again that this rolling part 15 may furthermore be normal to the axis 5 of turning so that, in its resting condition, the sample vessel 4 is parallel to the axis 5 of turning.

In the resting condition, that is to say when the rotor 1 is not being turned, a part of the rolling face 31 of lip 32 of the sample vessel 4 will be resting against the generally horizontal rolling part 15. When the rotor is started, the rolling face 31 of the lip 32 of the sample vessel 4 will be moved with a rolling motion on the rolling profile 11, it rolling over the swinging part 14 (see position B of the sample vessel 4) and on to the generally upright rolling part 13 of the rolling profile 11. Then the centrifuging or sample vessel 4 will have gone into the horizontal position C, in which the best possible centrifugal effect takes place because the centrifugal force is made best use of in this respect.

On turning off the rotor motor and/or braking the same, the rolling face 31 of lip 32 of the sample vessel 4 will be rolled in an opposite order from the upright rolling part 13 over pivot or swinging part 14 (position B of the sample vessel 4) on to the generally horizontal rolling part 15 so that the sample vessel goes back into the starting position A in which it was in in the first place.

The rolling profile or curve may be designed to be in line with special conditions and the special form of sample vessel 4 used in anyone case. The form of the rolling profile will be designed for each different case.

At the end of the centrifuging operation, the sample vessel 4 may be simply slipped out of the cutout 2 in the rotor 1 and then, together with the substance in it, may undergo further processing.

In the centrifuge of the present invention, the swinging motion takes place in a very simple way, that is to say only by rolling of the rolling face 31 of the flange or lip 32 of the sample vessel 4 on the rolling profile or curve 11. For the swinging motion, no moving or further parts are necessary so that the design of the centrifuge of the invention is very simple, this being true of upkeep as well. Furthermore, the rotor 1 of the invention of the centrifuge may be produced very low mass so that forces acting on the rotor bearing system are kept down and only a low motor power will be needed.

Although the account of the invention has been given using one single preferred working example, a man in the art will know of a great number of different changes in the design of the rotor and of the rolling curve or profile and furthermore in the sample vessel and the lip with the rolling face on it without giving up the teaching of the present invention. For example, it is possible for the rolling face 31 of the lip 32 not to be flat but to be made with some other rolling form if this gives a better effect for certain designs.

I claim:

1. In a centrifuge having a rotor and at least one sample vessel swingingly supported in said rotor for swinging into a horizontal position on running the centrifuge, the invention residing in that said centrifuge has a rolling system for supporting said vessel on said rotor, said system being made up of at least two cooperating rolling structures of which at least one is convexly curved, one structure being on the rotor and the other on the vessel, said convexly curved structure being arranged normal to a plane of rotation of said rotor, said structures being adapted to permit said sample vessel to swingingly turn into and out of a horizontal centrifuging position.

2. The centrifuge as claimed in claim 1, wherein one of said structures defines a convexly curved surface.

3. The centrifuge as claimed in claim 1, wherein one of said structures defines a convexly curved edge.

4. The centrifuge as claimed in claim 1, wherein said curved structure is a part of said rotor, and wherein the rolling structure cooperating therewith is defined by a support lip carried on the vessel for rolling on said curved structure for swinging motion of said vessel.

5. The centrifuge as claimed in claim 4, wherein said lip has a flat face for rolling on said curved structure.

6. The centrifuge as claimed in claim 4 or claim 5, wherein said lip is made in one piece with a remainder of said vessel.

7. The centrifuge as claimed in claim 4, wherein said support lip is separate from said vessel and is removably secured thereto.

8. The centrifuge as claimed in claim 1, wherein said rotor has at least one cutout for receiving said vessel, said cutout having sides which are normal to the direction of turning of said rotor and having said curved structures thereat.

9. The centrifuge as claimed in claim 8, wherein said rotor has a ring zone with an outline, as seen in radial cross-section, answering to the curved structure in form, said ring zone having therein a number of such cutouts taking up the vessel.

10. A centrifuge comprising, in combination, a rotor, at least one sample vessel, and holding means for suspending the vessel from the rotor so that the vessel is in a generally upwardly oriented position when the rotor is at rest and for permitting the vessel to swing into a generally horizontal position when the rotor turns, the holding means including a first profile defined by the rotor, facing towards an axis of rotation of the rotor, and having a convexly arcuate portion, and a second profile defined by the vessel and adapted to engage and to roll on the convexly arcuate portion of the first profile to permit the vessel to change its inclination between the generally upright orientation and the generally horizontal position.

11. A centrifuge according to claim 10 wherein the first profile is defined by a pair of spaced apart, parallel edges and the second profile is defined by portions of a surface located to cooperate with the pair of edges.

12. A centrifuge according to claim 11 wherein the surface defining the second profile is a substantially flat surface.

13. A centrifuge according to claim 12 wherein the first profile includes substantially straight edges contiguous with the convexly curved portion, the straight edge portions being arranged for engagement by the flat surface portions of the second profile and oriented to defined the upwardly inclined orientation of the vessel and the substantially horizontal position of the vessel when engaged by corresponding sections of the flat surface of the second profile.

14. A centrifuge for use with a vessel having means defining a generally downwardly facing lip when the vessel is in its upright position, the centrifuge comprising a rotor, means defining a cutout in the rotor adapted to receive the vessel so that the lip of the vessel is generally above the rotor and the vessel depends through the cutout, and bearing means defined by the rotor, engaging the lip and having a convexly shaped member positioned with respect to the vessel so that the lip engages the member and, upon rotation of the rotor, rollingly moves along the member as the vessel moves under centrifugal forces from a generally upwardly oriented position into a generally horizontal position and, upon cessation of the rotation of the rotor, back into its generally upwardly oriented position.

15. A centrifuge comprising a rotor including a peripheral ring zone defining an opening, at least one sample vessel, the opening being shaped to receive the vessel, the vessel including at its upper end lip means defining a downwardly facing first vessel support structure; the rotor including at the opening a second support structure formed to engage the first support structure and hold the vessel; the opening, the first and the second support structures being shaped to permit movement of the vessel from a generally upright, rest position, into a generally horizontal position when subjected to centrifugal forces and limiting contact between the vessel and the rotor to rolling contact only.

* * * * *